US005113703A

United States Patent [19]

Hearn

[11] Patent Number: 5,113,703

[45] Date of Patent: May 19, 1992

[54] TUBING END LOCATING APPARATUS FOR WELLBORES

[75] Inventor: David D. Hearn, Richardson, Tex.

[73] Assignee: Atlantic Richfield Company, Los Angeles, Calif.

[21] Appl. No.: 564,932

[22] Filed: Aug. 9, 1990

[51] Int. Cl.[5] ..... E21B 43/00

[52] U.S. Cl. ..... 73/151; 166/255

[58] Field of Search ..... 166/329, 255; 73/151; 33/777

[56] References Cited

U.S. PATENT DOCUMENTS

| | | | |
|---|---|---|---|
| 2,859,013 | 11/1958 | Peterson | 73/151 |
| 3,696,865 | 10/1972 | Chapman | 166/255 |
| 3,867,985 | 2/1975 | Wilkinson | 166/329 |
| 3,888,306 | 6/1975 | Wetzel | 166/255 |
| 4,407,157 | 10/1983 | Lichtenberg | 73/151 |

*Primary Examiner*—Hezron E. Williams
*Assistant Examiner*—George Dombroske
*Attorney, Agent, or Firm*—Michael E. Martin

[57] ABSTRACT

The lower end of a wellbore tubing string or a change in diameter of a wellbore component may be sensed by an apparatus connectable to the end of an elongated coilable tubing for insertion into the tubing string and responsive to movement of the apparatus into or out of the end of the tubing string to effect a change in flow of fluid being conducted through the coilable tubing. The apparatus includes opposed arms engageable with the bore of the tubing string and engageable with a piston member to effect closure of ports in the apparatus to change the flow of fluid through the tubing in response to movement of the arms into or out of the end of the tubing string. Alternate embodiments include bypass passages for conducting pressure fluid to a packer or wellbore tool.

16 Claims, 3 Drawing Sheets

TUBING END LOCATING APPARATUS FOR WELLBORES

BACKGROUND OF THE INVENTION

1. Field of the Invention

The present invention pertains to an apparatus for connection to the distal end of a tube for insertion in a tubing string or pipe string in a wellbore and for locating the lower end of the tubing string by measuring a change in fluid pressure within the tube to which the apparatus is connected.

2. Background

Many wellbore operations require accurate depth determination, particularly in connection with so-called coiled tubing operations. The accurate determination of the depth of a device connected to the lower end of the coiled tubing string can be particularly critical for operations such as setting inflatable packers and bridge plugs, performing underreaming operations and performing squeeze cementing operations using coilable tubing. Many of these operations are required to be carried out within a few feet of existing wellbore structures such as casing perforations to effectively isolate a zone within an earth formation.

Conventional methods for determining the depth of a tool or device connected to the end of a tubing string while being inserted within another tubing or pipe string within a wellbore have certain shortcomings. For example, devices are known which rely on a change in the reading of the tubing string tension or weight indicator to indicate when a tool or other device connected to the end of the coiled tubing has come in contact with a stop or restriction at a known position in the wellbore tube or pipe string. The lower end of the production tubing string or, more precisely, the end of the production tubing tailpipe is often used as a convenient reference point of known depth. Mechanical tubing end or "tail" locator devices rely on engagement with the lower end of the tubing string, which engagement is sensed by a change in the weight indicator on the coiled tubing to which the device is connected. If resistance to movement of the device upon engagement of the tubing tail or distal end is great enough to be read by the tubing weight indicator at the surface, the end of the coiled tubing can be located in reference to a known position downhole.

However, using an increase in tubing tension as an indicator of location downhole is difficult, particularly, in highly deviated wellbores due to the considerable frictional drag encountered during insertion and movement of the coiled tubing. This change in tension sometimes is, when applied to the stress already on the coiled tubing string, enough to exceed the strength of the tubing string. Additionally, this frictional drag can vary considerably and result in erratic weight indicator readings. If the resistance of movement of the tubing end locator mechanism is set at a relatively low value, so as to prevent the mechanism from being lodged in the tubing or pipe string, the mechanism may not provide for a significant change in tubing tension to be read at the weight indicator.

Still further, certain tubing end configurations may be somewhat funnel-shaped to permit re-entry of wireline conveyed devices and other tools. These tubing end shapes do not present significant resistance to the mechanical tubing locator devices to register a change in tension on the tubing string to which the device is connected. Accordingly, there has been a need for improvement in tubing end and other downhole position reference locating devices which would overcome the abovementioned disadvantages of known types of devices.

SUMMARY OF THE INVENTION

The present invention provides an apparatus for determining the location of the lower end of a tubing string or the location of certain structures in a wellbore.

In accordance with one important aspect of the present invention, a unique apparatus is provided for connection to the distal end of an elongated tubing, such as coilable tubing, for insertion in a wellbore tubing or pipe string for determining the location of the lower end of the tubing or pipe string or other structure wherein a change in the inner diameter or bore of the tubing or pipe string is sensed for locating certain tools and other operating devices, and with respect to the tubing or pipe string. The apparatus is adapted to cause a change in flow of fluid being pumped through the tubing to which the apparatus is connected.

In accordance with another aspect of the present invention there is provided an apparatus for determining the location of the lower end of a pipe or tubing string with respect to an elongated tubing which has been inserted into the wellbore and within the tubing or pipe string by causing a change in pressure of a fluid being pumped into the tubing during the insertion or withdrawal process.

The present invention provides a unique apparatus which may include one or more moveable arms which react to movement into or out of the lower end of a pipe or tubing string or movement into or out of a bore of enlarged or reduced diameter within a pipe or tubing string, which movement effects a change in the flow of fluid through the tubing and whereby a change in the pressure of the fluid may be sensed as a way of determining when the end of the pipe or tubing string or the change in bore diameter has been encountered.

The present invention still further provides an apparatus for determining the location of an end of a pipe or tubing string in a wellbore which is operable to conduct pressure fluid through said apparatus for various purposes. The apparatus includes a piston moveable in response to the apparatus encountering a change in the bore diameter of a tubing or pipe string to effect an increase or decrease of flow of fluid through the apparatus, which fluid may be used for certain wellbore operations. In one embodiment of the apparatus, means are provided for effecting shut-off of flow of fluid through one path in the apparatus upon encountering a change in diameter or the end of a pipe or tubing string while providing passage means for the continued flow of fluid through the apparatus to effect operation of tools connected to or depending from the apparatus. The last-mentioned embodiment of the apparatus is particularly useful in conjunction with inflatable packers and other mechanisms which require pressure fluid to operate within a wellbore.

The invention further provides a method for improved operation of tools connected to coilable tubing wherein fluid can be circulated through the coilable tubing string as it is fed in or out of a wellbore, fluid flow can be sensed at the surface as a change in pressure to indicate the location of the apparatus with respect to a tubing or pipe string end or a change in bore diameter of the tubing or pipe string whose location is desired to be known and whereby hydraulic pressure rather than mechanical tension or weight acting on the coilable tubing is used to indicate a change in diameter within a wellbore structure.

Those skilled in the art will recognize the above described features and advantages of the present invention together with other superior aspects thereof upon reading the detailed description which follows in conjunction with the drawing.

DESCRIPTION OF PREFERRED EMBODIMENTS

Figure 1:
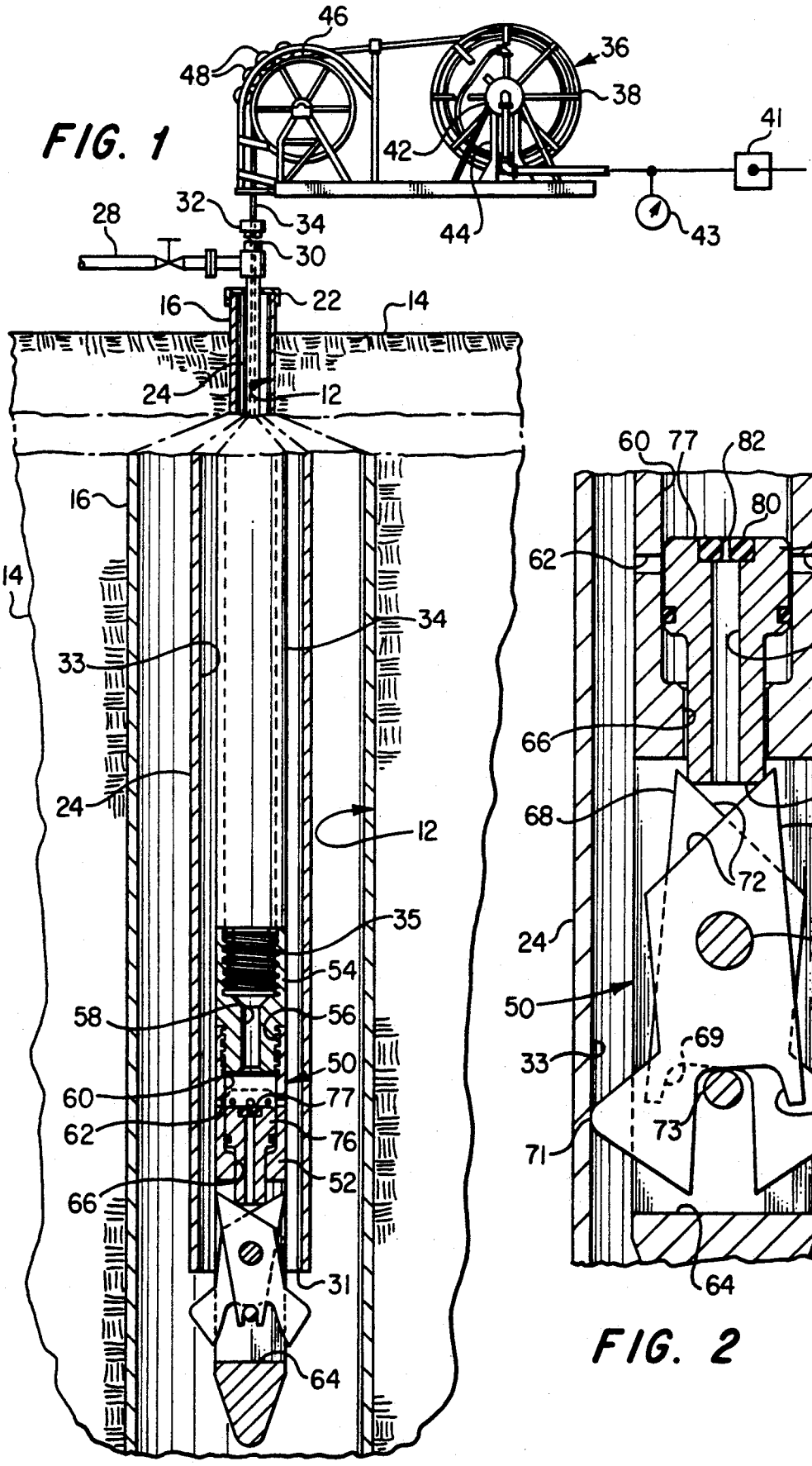
FIG. 1 is a view in somewhat schematic form of a wellbore showing the apparatus of the present invention connected to a coilable tubing string inserted in the wellbore.

In the description which follows like parts are marked throughout the specification and drawing with the same reference numerals, respectively. The drawing figures are not necessarily to scale and certain features may be shown in somewhat schematic form or in different scales in the interest of clarity and conciseness.

Referring to FIG. 1 there is illustrated a wellbore generally designated by the numeral 12 and penetrating an earth formation 14. The wellbore is provided with a suitable casing 16 which extends to a wellhead 22. FIG. 1 is shown at two different scales in the interest of clarifying the details of the apparatus to be described further herein. An elongated tubing or pipe string 24 is also secured within the casing 16 and extends to communication with a flow conduit 28 and a lubricator 30 having a suitable closure member or stuffing box 32 secured to the top end thereof. The lower end of the tubing or pipe string 24 is delimited by a distal end 31. The interior of the tubing or pipe string 24 is typically a smooth, generally constant diameter bore 33, although the tubing or pipe string may have interposed therein certain elements, not shown, having a larger bore diameter.

In the arrangement illustrated in FIG. 1, an elongated coilable tubing 34 is inserted in the tubing string 24 through the stuffing box 32, lubricator 30 and the wellhead 22. The tubing 34 is adapted to be inserted into and withdrawn from the tubing string 24 by a coilable tubing injection unit, generally designated by the numeral 36. The injection unit 36 includes a reel 38 on which a substantially continuous length of tubing 34 is adapted to be wound and unwound and, by suitable means not shown, connected at one end to a source of pressure fluid including a conduit 40 and a pump 41. Pressure sensing and indicating means 43 is connected to the conduit 40 for sensing a change in pressure in fluid being pumped through the conduit and the tubing 34 by way of a suitable transfer mechanism associated with the reel 38. A detailed description of a suitable mechanism for effecting the transfer of fluid from the conduit 40 to the reel 38 is disclosed in U.S. Pat. No. 4,685,516 to L. J. Smith and assigned to the assignee of the present invention. The tubing string 34 is trained over a guide reel 46 and suitable guide rollers 48 as it is fed into the wellbore by way of the stuffing box 32 and lubricator 30.

Figure 2:
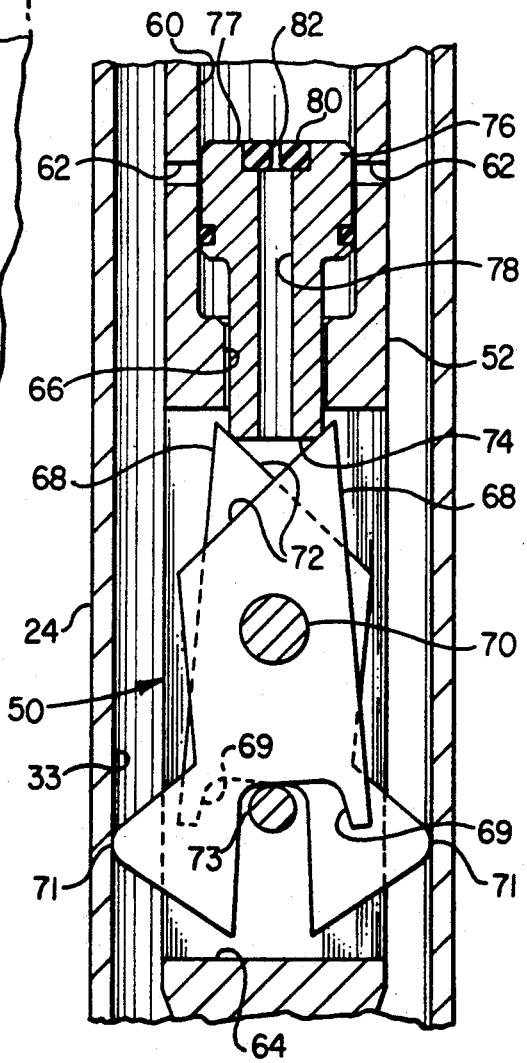
FIG. 2 is a detail section view showing the apparatus illustrated in FIG. 1 in a position to substantially block flow of fluid through the coiled tubing.

As shown in FIG. 1, the lower end 35 of the tubing 34 comprises a threaded coupling which is connected to an apparatus in accordance with the present invention and generally designated by the numeral 50. The apparatus 50 is operable in conjunction with the tubing 34 to indicate when the tubing 34 has reached the lower or distal end 31 of the tubing or pipe string 24, either in reference to movement of the tubing 34 into or downwardly through the tubing string 24 or during withdrawal of the tubing 34, generally upwardly through the tubing or pipe string 24. Referring also to FIG. 2, the apparatus 50 includes an elongated generally cylindrical body member 52 which is suitably threadedly coupled to an adapter member 54 at coupling threads 56. The adapter member 54 is, in turn, threadedly coupled to the tubing end 35. The adapter member 54 includes a flow passage 58 formed therein which opens into a bore 60 formed in the body member 52. A plurality of radially extending ports 62 open from the bore 60 to the exterior of the body member 52.

The body member 52 further includes an elongated, generally rectangular slot 64 formed therein and in communication with a reduced diameter bore portion 66 which opens into the bore 60. A pair of opposed arms 68 are pivotally mounted on the body member 52 in the slot 64 on a pivot pin 70 which is supported by the body member. The arms 68 include cam surfaces 72 formed thereon and engageable with the distal end 74 of a stepped piston 76 slidably disposed in the bore 60 and extending through the bore 66. A reduced diameter portion 75 of the piston 76, which includes the end 74, is slightly smaller in diameter than the width of the slot 64. The piston 76 includes a central longitudinal passage 78 formed therein and an orifice plug 80 disposed at one of the passage and including a reduced diameter orifice passage 82 in communication with the bore 60 and the passage 78 for restricting flow through the passage 78 from the bore 60.

The arms 68 include respective stop surfaces 69 formed thereon and engageable with a stop pin 73 disposed in the slot 64. Opposed cam surfaces 71 are engageable, as shown in FIG. 2, with the bore wall 33 of the tubing 24 to hold the piston 76 in a position covering the ports 62 from communication with the bore 60. However, as shown in FIG. 1, when the apparatus 50 moves out of the end of the tubing string 24 fluid pressure acting on the face 77 of the piston 76 will force the piston to move downwardly uncovering the ports 62 to allow fluid to flow relatively free from the tubing 34 into the wellbore. When the apparatus 50 is disposed with its cam surfaces 71 engaged with the bore wall 33 of the tubing 24 the piston 76 is forced upwardly into the position shown in FIG. 2 blocking the flow of fluid through the ports 62. A small amount of fluid is permitted to flow through the orifice 82 and the passage 78 at all times to wash over the arms 68 to minimize possible contamination or clogging of the slot 64 with debris from the wellbore.

Accordingly, the operation of the apparatus 50 may be carried out during movement of the tubing 34 downwardly through the tubing 24 with the apparatus 50 in the position shown in FIG. 2, substantially blocking the flow of pressure fluid through the tubing 34 and into the interior of the tubing 24. If the pressure of the fluid in the tubing 34 is monitored as the tubing is being pushed downwardly through the tubing string 24, the operator will notice the change in pressure caused by the change in fluid flow through the tubing once the cam surfaces 71 exit the lower end of the tubing string 24 and the arms pivot to the position shown in FIG. 1 under the urging of pressure fluid acting on the piston 76. The increase in flow permitted by uncovering the ports 62 will be recognized by a pressure drop sensed at the pressure sensing means 43 indicating when the apparatus 50 has moved past the end 31 of the tubing string 24. Conversely, the operation of the apparatus may be carried out somewhat in reverse to that described above, that is, by moving the apparatus 50 from a position below the tubing end 31 upward until the arms 68 are actuated to the position of FIG. 2 indicated by an increase in the fluid pressure in the tubing 34 sensed at sensing means 43.

Those skilled in the art will recognize that it is not necessary that the apparatus 50 be moved into or out of the end of a tubing string as illustrated in FIGS. 1 and 2 and described above, but if the arms 68 encounter a change in diameter of a tubing or other component in a pipe or tubing string, sufficient to effect movement of the piston 76 to cover or uncover the ports 62, then the location of that change in diameter may also be sensed with respect to the apparatus 50 and the length of tubing 34 inserted in the wellbore to determine the location of the apparatus with respect to certain wellbore components.

Figure 3:
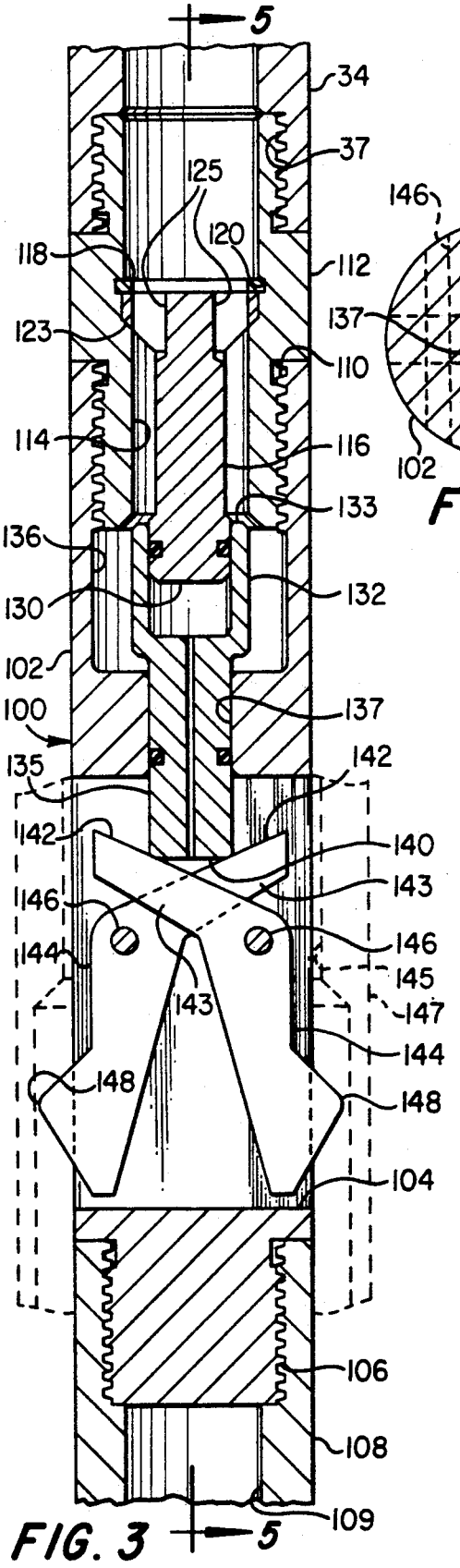
FIG. 3 is a longitudinal central section view of a first alternate embodiment of an apparatus in accordance with the present invention for conducting fluid flow through the apparatus to a portion of a tubing string downhole.
Figure 4:
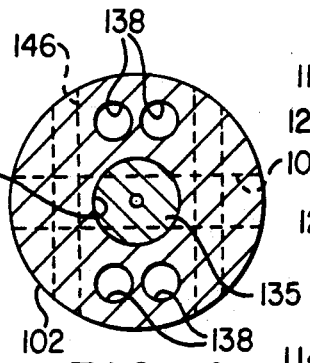
FIG. 4 is a section view taken along the line 4—4 of FIG. 5.
Figure 5:
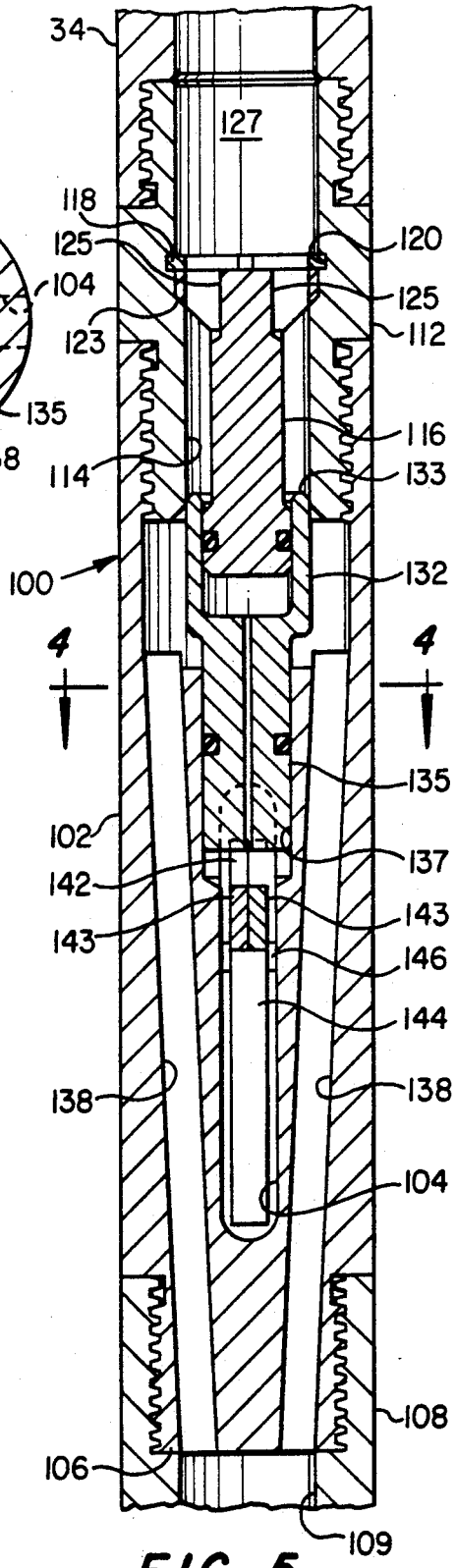
FIG. 5 is a section view taken along with line 5—5 of FIG. 3.

Referring to FIGS. 3, 4 and 5 an alternate embodiment of the present invention in the form of a locating apparatus is illustrated and generally designated by the numeral 100. The apparatus 100 is adapted to be connected to the lower end of a tubing such as the tubing 34 modified to have internal threads 37 formed on the end thereof, the apparatus 100 is characterized by an elongated, generally cylindrical body member 102 having a centrally located transverse slot 104 extending therethrough, as illustrated. The body 102 includes a lower threaded end portion 106 for threadedly connecting the apparatus 100 to a tubing member or tool member 108 disposed below the apparatus with respect to the tubing 34. The apparatus 100 is particularly adapted to be interposed between a tubing string, including the tubing 34, and certain components or tools located below the apparatus and which require fluid flow to operate or perform their intended function, which fluid flow is conducted through the tubing 34 and the apparatus 100 as will be described in further detail hereinbelow.

The body member 102 includes an upper threaded end portion 110 which is threadedly connected to an adapter part 112 which, in turn, is connected to the tubing 34, as shown. The adapter part 112 includes a central bore or fluid passage 114 in which is disposed an elongated piston guide 116 which is retained in the bore by a conventional retaining ring 118 seated in a groove 120. The piston guide 116 includes a tapered seat portion 123 which is seated in a cooperating recess formed in the bore 114, as illustrated. Passages 125 are formed in the guide 116 to permit fluid flow from the tubing 34 and the space 127 through the bore 114. The lower end of the piston guide 116 includes a head portion 130 over which is slidably disposed a generally cylindrical hollow piston 132 which is moveable into the bore 114 to form a closure member for shutting off fluid flow from the bore 114 into a space defined by a bore 136 formed in the body member 102.

As shown in FIGS. 4 and 5, the bore 136 is in communication with elongated passages 138 extending from the bore 136 through the end 106 of the body member 102. Accordingly, when the piston 132 is in the position illustrated in FIG. 3, fluid may flow from the tubing 34 through the space 127 the passages 125, the bore 114, the bore 136 and the passages 138 to the tubing or tool member 108 which is provided with an internal flow passage 109.

The piston 132 includes a reduced diameter portion 135 which extends through a bore 137 formed in the body member 102 between the bore 136 and the slot 104. The lower end 140 of the piston 132 is engaged with opposed cam surfaces 142 formed on respective arms 144 which are pivotally mounted on the body member 102 in the slot 104 as illustrated for pivotable movement about respective pivot pins 146. The arms 144 each include cam surfaces 148 which are engageable with the borewall 33 of a tubing such as the tubing 24 illustrated in FIG. 1 or the restricted diameter borewall 145 of the wellbore member 147 shown in FIG. 3 for moving the piston 132 to the position shown in FIG. 5 to block the flow of pressure fluid from the bore 114 into the bore 136.

Accordingly, when the apparatus 100 is utilized to locate the end of a tubing string such as the tubing string 24, or an enlargement or constriction in a wellbore member, pressure fluid being conducted down through the tubing 34 will undergo a change in fluid pressure which may be sensed at the surface to indicate the location of the apparatus 100 and any tools or other devices connected thereto. An example of operation of the apparatus 100 when connected to a tubing 34 and to a wellbore device or tool 108 would be in the instance where the tool 108 includes certain types of jetting or dispensing nozzles for ejecting fluid into the wellbore member 147 or into a formation zone of interest. The tubing 34 and the apparatus 100 together with the tool or device 108 would be lowered through the tubing 24 and out of the end 31 of the tubing whereby pressure fluid acting on the piston end face 133 would force the piston downwardly to the position of FIG. 3 and pivoting the arms 144 to the position shown. This step could be followed by withdrawing the apparatus 100 into the tubing until the cam surfaces 148 engage the tubing 24 or the restricted bore 145 and effect movement of the arm portions 143 and the cam surfaces 142 to urge the piston 132 upwardly to the position shown in FIG. 5 thereby blocking the flow of pressure fluid down through the apparatus. Such action would be sensed by a change in fluid pressure as indicated at the pressure sensing means 43, for example. This would indicate to operating personnel the location of the apparatus 100 and the device 108. The tubing 34 could then be lowered again slightly to allow the arms 144 to pivot so as to permit the piston 132 to move downwardly to the position shown in FIG. 3. In the position shown in FIG. 3, fluid may be conducted down through the tubing 34, the passage 127, the passages 125, the bore 114, the bore 136 and the passages 138 to the passage 109 for performing wellbore operations with said fluid. Accordingly, the apparatus 100 is useful for locating the end of a tubing string such as the tubing string 24 as well as other known positions in a wellbore as defined by a change in diameter of a tubing string or wellbore member and whereby fluid flow may be conducted through the apparatus to perform certain operations at a point beyond the end of the apparatus which is opposite the end which is connected to the tubing 34.

Figure 6:
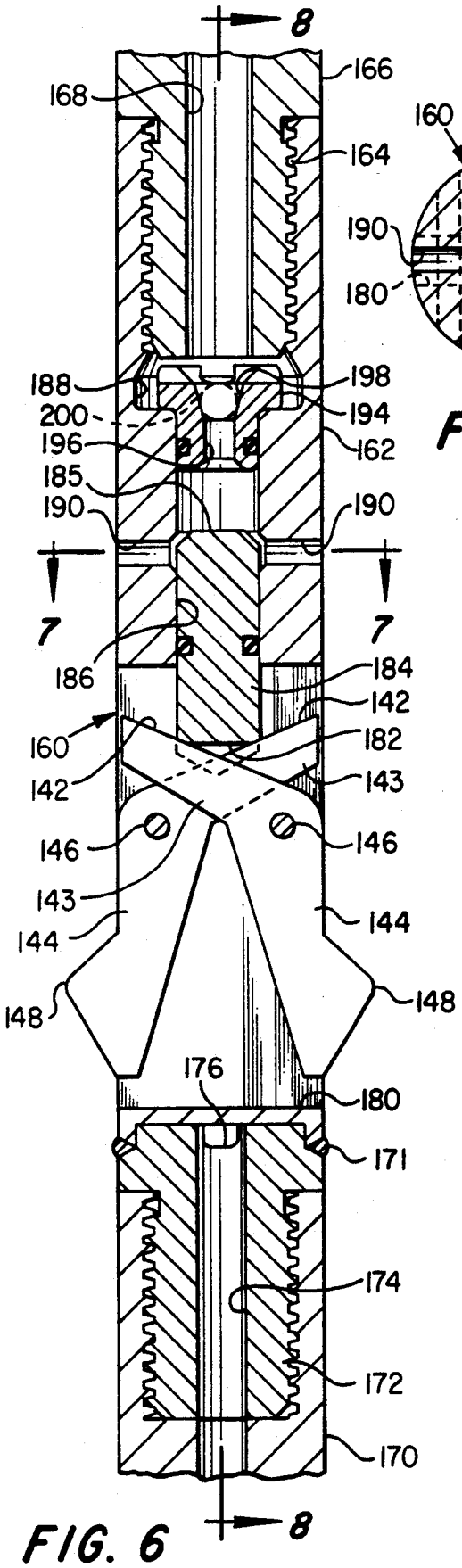
FIG. 6 is a longitudinal central section view of a second alternate embodiment of the present invention for use in conjunction with inflatable packers and other tools requiring pressure fluid flow thereto.
Figure 7:
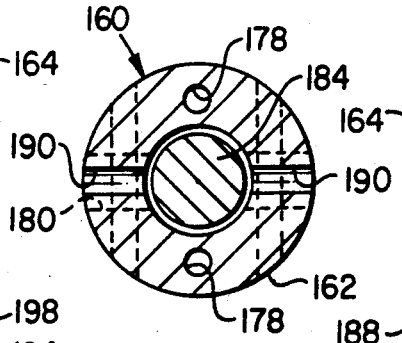
FIG. 7 is a section view taken along the line 7—7 of FIG. 6.
Figure 8:
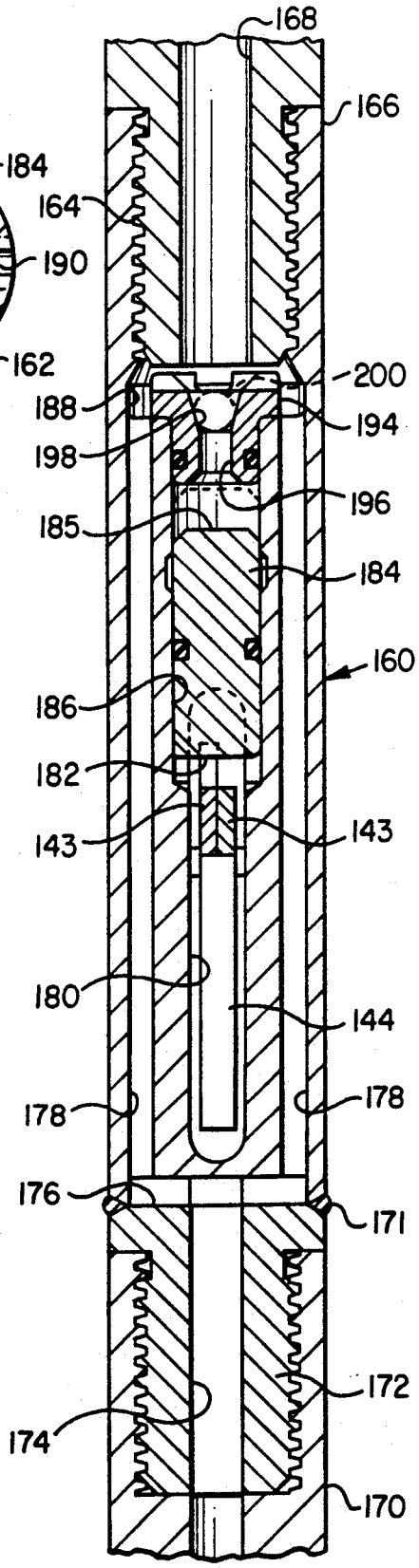
FIG. 8 is a section view taken along the line 8—8 of FIG. 6.

Referring now to FIGS. 6, 7 and 8, a second alternate embodiment of a locator apparatus is illustrated and generally designated by the numeral 160. The apparatus 160 is particularly adapted to be used in conjunction with placing inflatable packers and similar devices downhole and includes an elongated generally cylindrical body member 162 having an upper end portion which is internally threaded at 164 for connection to an adapter part 166. The adapter part 166 may, in turn, be suitably adapted for connection to the tubing 34, not shown in FIG. 6 or 8, and includes an elongated central passage 168 for conducting pressure fluid from the tubing 34 to the body part 162 and to an inflatable packer or the like 170 which is threadedly connected to the lower end of the body member 162 at a threaded lower head part 172. The head part 172 includes an internal longitudinal passage 174 and transverse passage means 176 formed therein and in communication with spaced apart longitudinal passages 178, FIGS. 7 and 8. The head part 172 may, as illustrated, be fabricated separate from the body part 160 and suitably attached thereto as by welding at 171.

The body member 162 includes an elongated, generally transverse extending slot 180 for accommodating the pivotally mounted tubing sensing arms 144 which are supported for pivotal movement on the body member by spaced apart pivot pins 146. The cam surfaces 142 of the arms 144 are engageable with the end 182 of a piston member 184 which is disposed in a bore 186 formed in the body member 162 and extending longitudinally between the slot 180 and an enlarged bore portion 188 which is in communication with the passage 168 and the passages 178, FIG. 8. Fluid exit ports 190 open into the bore 186 from the exterior of the body member 162. A closure seat member 194 is disposed in the bore 186 and is retained therein upon assembly of the body member 162 to the adapter 166. The seat member 194 is provided with a passage 196 extending therethrough and which as a bevelled portion forming a seat 198 for a closure ball 200, FIGS. 6 and 8, to prevent flow of fluid through the passage 196 and the ports 190. The ball 200 may be placed in the closure position illustrated in FIG. 8 by dropping same in a fluid flow stream through the tubing 34 and the passage 168 until it seats in the seat member 194.

The operation of the apparatus 160 is similar to that of the apparatus 100 or the apparatus 50 except the apparatus 160 is typically used in conjunction with inflatable packers and other devices requiring high pressure fluid to be introduced there into through the tubing 34 and the adapter 166. For example, the apparatus 160 and the packer 170 may be lowered into a wellbore through the tubing 24 on the distal end of the tubing 34 in place of the apparatus 50 as illustrated in FIG. 1. Once the arms 144 have exited the end 31 of the tubing 24 pressure fluid acting on the face 185 of the piston 84 will move the arms to the position illustrated in FIG. 6 and uncover the ports 190 for permitting flow of fluid therethrough. Conversely, if the apparatus 160 is being drawn into a more restricted bore in a tubing, such as the tubing 24 or other wellbore member, movement of the arms 144, upon engagement of the cam surfaces 148 with a restricted diameter, will cause the piston 184 to move upward closing the ports 190. In either case, a change in fluid pressure of fluid flowing through the tubing 34 and the passage 168 will be sensed and the location of the apparatus 160 may be determined.

If a tool such as an inflatable packer, requiring relatively high pressure fluid to be introduced thereinto is attached to the tool 160 then, upon determining the location of the apparatus 160 and in order to shut off flow of fluid through the ports 190 and prevent movement of the piston 184 the closure ball 200 may be dropped down the tubing string and the passage 168 to lodge in the position shown in FIGS. 6 and 8. In this position the flow of pressure fluid is restricted to the path which includes the passage 168, the bore 188, the passages 178 and 176 and the passage 174 leading to the packer 170.

The preferred embodiments of the apparatus described herein above may be fabricated using conventional engineering practices and materials for wellbore tools and the like. Although the embodiments of the apparatus are described as being useful with coilable tubing, the apparatus may be used with rigid tubing members or the like, also. The tubing string 24 may have one or more wellbore members, such as the wellbore member 147, interposed therein and which may be considered part of the tubing string for purposes of this description. Preferred embodiments of wellbore locator apparatus have been described, but those skilled in the art will recognize that various substitutions and modifications may be made to the specific configurations disclosed without departing from the scope and spirit of the invention as recited in the appended claims.

What is claimed is:

1. Apparatus for determining the location of at least one of the distal end of a tubing string in a wellbore and a change in bore diameter of a wellbore member and useful in conjunction with an elongated tubing insertable in said at least one of said tubing string and said wellbore member, said apparatus comprising:

a body member including means for connecting said apparatus to an elongated tubing for insertion in said wellbore, said body member including first passage means formed therein for conducting pressure fluid within said apparatus from said elongated tubing;

means on said apparatus engageable with said at least one of said tubing string and said wellbore member and moveable in response to a change in diameter of a surface of said tubing string and said wellbore member; and closure means responsive to movement of said means engageable with said surface to effect a change in flow of fluid in said apparatus.

2. The apparatus set forth in claim 1 wherein:

said means engageable with said surface includes at least one arm pivotally supported on said body member and including a cam surface engageable with a bore wall of said tubing string.

3. The apparatus set forth in claim 2 wherein:

said arm includes a cam surface engageable with said closure means for moving said closure means in response to movement of said arm.

4. The apparatus set forth in claim 3 wherein:

said body member includes second passage means formed therein for conducting pressure fluid from said elongated tubing to a member connected to said apparatus.

5. The apparatus set forth in claim 4 wherein:

said apparatus includes a seat member interposed in said body member between said first and second passage means for receiving a closure member to shut off the flow of fluid to said closure means.

6. An apparatus for determining the location of a reference point on a coiled tubing with respect to an elongated pipe string disposed in a wellbore and in which said tubing is disposed, comprising:

an elongated body member including means for connecting said body member to said tubing, said body member including a generally transverse extending slot formed therein;

a pair of opposed arms pivotally supported on said body member in said slot and including, respectively, first opposed cam surfaces engageable with an interior wall of said pipe string, said arms including, respectively, second cam surfaces formed thereon;

a closure member disposed in a bore formed in said body member and including a portion engageable with said second cam surfaces on said arms for movement from a first position to a second position;

port means formed in said body member and opening to said bore for conducting pressure fluid from said tubing in response to said closure member being in said one of said positions, said closure member being moveable to the other of said positions in response to engagement of said first cam surfaces with said tubing string to effect a change in flow of fluid through said port means.

7. The apparatus set forth in claim 6 including:

bypass passage means formed in said body member for conducting pressure fluid from said tubing to a tool connected to said body member.

8. The apparatus set forth in claim 7 including:

a closure seat formed in said body member and including passage means in communication with said port means in one of said positions of said closure member for conducting pressure fluid from said tubing to said port means, and a closure ball operable to be disposed in engagement with said seat means to close off flow of fluid to said port means without closing off flow of fluid through said bypass passage means.

9. An apparatus for determining the location of a reference point on a coiled tubing with respect to an elongated pipe string disposed in a wellbore and in which said tubing is disposed, comprising:

an elongated generally cylindrical body member including means for connecting said body member to said tubing, said body member including a generally transverse extending slot formed therein;

a pair of opposed arms pivotally supported on said body member in said slot and including, respectively, first opposed cam surfaces engageable with an interior wall of said pipe string, said arms including, respectively, second cam surfaces formed thereon;

a closure member disposed in a bore formed in said body member and including a portion engageable with said second cam surfaces on said arms for movement from a first position to a second position;

port means formed in said body member and opening to said bore for conducting pressure fluid from said tubing in response to said closure member being in said first position, said closure member being moveable to said second position in response to engagement of said first cam surfaces with said tubing string to substantially shut off flow of fluid through said port means.

10. A locating system for use in conjunction with a tubing or pipe string in a wellbore for locating at least one of the lower distal end of said tubing or pipe string and a change in bore diameter of a wellbore member connected to said tubing or pipe string, said system comprising:

an elongated tubing including means for inserting and withdrawing said tubing with respect to said tubing string;

means for conducting pressure fluid through said tubing;

means for sensing a change in the pressure of said fluid being conducted through said tubing; and an apparatus connected to an end of said tubing for sensing said end of said tubing string, said apparatus comprising a body member including passage means formed therein for receiving pressure fluid from said tubing and port means in communication with said passage for conducting pressure fluid therethrough, a closure member disposed on said body member and moveable between first and second positions to substantially close off flow of fluid through said port means, and means connected to said body member and engageable with a surface of said tubing string to hold said closure member in said first position, said closure member being moveable to said second position in response to said apparatus exiting said end of said tubing string to effect a change in fluid flow through said tubing.

11. The system set forth in claim 10 wherein:

said means engageable with said surface of said tubing string includes a pair of opposed arms pivotally mounted on said body member and engageable with said surface of said tubing string and said closure member whereby in response to movement of said apparatus with respect to said end of said tubing string pressure fluid flow through said body member is changed to effect a change in fluid pressure in said tubing.

12. The system set forth in claim 11 wherein:

said body member includes bypass passage means for conducting pressure fluid to means connected to an end of said apparatus opposite an end which is connected to said tubing.

13. The system set forth in claim 12 wherein:

said apparatus includes a closure seat formed thereon for receiving a closure ball to shut off flow of fluid to said port means.

14. The system set forth in claim 10 wherein:

said closure member includes a surface responsive to pressure fluid acting thereon to move between said first and second positions.

15. A method for determining the location of a reference point on a tubing string with respect to a reference point on a pipe string disposed in a wellbore, which tubing string is insertable within said pipe string, including the steps of:

providing said tubing string including means for conducting pressure fluid through said tubing string;

providing an apparatus connected to said tubing string, said apparatus comprising a body member including passage means formed therein for receiving pressure fluid from said tubing string and port means in communication with said passage means for conducting pressure fluid therethrough, a closure member disposed on said apparatus and movable between a first position and a second position to substantially close off flow of pressure fluid through said port means, and means connected to said apparatus and engageable with a surface on said pipe string to hold said closure member in one of said positions, said closure member being movable to the other of said positions in response to said apparatus moving past said reference point on said pipe string to effect a change in fluid flow through said tubing string;

providing means for sensing said change in fluid flow through said tubing string;

inserting said tubing string and said apparatus within said pipe string and moving said apparatus through said pipe string while monitoring said means for sensing; and determining the location of said apparatus within said pipe string in response to sensing said change of fluid flow in said tubing string in response to said closure member moving to said other position.

16. The method set forth in claim 15 wherein:

said apparatus includes closure seat means interposed between said passage means and said port means and said method includes the steps of;

providing a second closure member insertable within said tubing string for engagement with said seat means; and inserting said second closure member in said tubing string and pumping said second closure member into engagement with said seat means to block the flow of pressure fluid through said port means while permitting the flow of fluid through said passage means.

* * * * *